United States Patent [19]

Samuelson

[11] Patent Number: 4,853,082

[45] Date of Patent: Aug. 1, 1989

[54] PROCESS FOR THE ACTIVATION AND DELIGNIFICATION OF CELLULOSE PULP

[75] Inventor: Hans O. Samuelson, Gothenburg, Sweden

[73] Assignee: Mooch Domsjo Aktiebolag, Ornskoldsvik, Sweden

[21] Appl. No.: 60,131

[22] Filed: Jun. 9, 1987

Related U.S. Application Data

[63] Continuation-in-part of Ser. No. 938,935, Dec. 8, 1986.

[51] Int. Cl.[4] ..... D21C 3/16

[52] U.S. Cl. ..... 162/38; 162/39; 162/43; 162/44; 162/45; 162/81; 162/63

[58] Field of Search ..... 162/43, 63, 44, 45, 162/38, 39, 81

[56] References Cited

U.S. PATENT DOCUMENTS

| | | | |
|---|---|---|---|
| 3,578,553 | 5/1971 | Godsay et al. | 162/81 |
| 4,076,579 | 2/1978 | Brink | 162/81 |
| 4,406,735 | 9/1987 | Samuelson | 162/81 |
| 4,439,271 | 3/1984 | Samuelson | 162/81 |

*Primary Examiner*—Steve Alvo

[57] ABSTRACT

A process is provided for the activation and delignification of cellulose pulp, which comprises:

(1) subjecting chemical cellulose pulp to activation by reaction with nitrogen dioxide in the presence of water at a temperature within the range from about 20° to 120° C., while (a) separating gas containing at least 1.2 mml nitrogen oxides, including NO, per liter of gas determined at 25° C. and calculated as nitrogen, reacting nitrogen oxides in said withdrawn gas with oxygen gas in an amount within the range from about 10 to about 200 mole percent, calculated on the amount of NO present, and recycling the reacted gas to the activation; and (b) separating gas containing less than 0.4 mml nitrogen oxides, including NO, per liter of gas determined at 25° C. and calculated as nitrogen from the cellulose pulp and removing said gas from the process; and (2) delignifying the activated cellulose pulp.

9 Claims, 2 Drawing Sheets

PROCESS FOR THE ACTIVATION AND DELIGNIFICATION OF CELLULOSE PULP

This application is a continuation-in-part of Ser. No. 938,935, filed Dec. 8, 1986.

It has been found that the delignification of lignocellulosic material can be effected to a considerably higher degree than was previously thought to be possible, without using chlorine or chlorine compounds, by activating lignocellulosic material such as cellulose pulp by reacting the material in the presence of water with a gas that contains nitrogen dioxide, prior to subjecting the material to delignification in one or more stages.

The reaction or activation of lignocellulosic material, including cellulose pulp, with nitrogen oxides in the presence of water is described in many patents, including, for example, the following:

| Patent No. Date of Patent | Serial No. Filing Date | Title | Inventor |
|---|---|---|---|
| 4,602,982 July 29, 1986 | 556,498 Nov. 30, 1983 | Process for Delignifying Bleaching Lignin Containing Cellulose Pulp by Activating the Pulp with $NO_2$ and $O_2$ Gas in the presence of Water, Sodium Nitrate and Nitric Acid | Samuelson |
| 4,445,969 May 1, 1984 | 449,889 Dec. 16, 1982 | Process for the Delignifying Bleaching of Cellulose Pulp by Activating the Pulp with $NO_2$ and Oxygen | Samuelson |
| 4,439,271 March 27, 1984 | 270,438 June 4, 1981 | Process for the Oxygen Bleaching of Cellulose Pulp | Samuelson |
| 4,406,735 Sept. 27, 1983 | 267,968 May, 27 1981 | Process for Alkaline Oxygen Gas Bleaching of Cellulose Pulp | Samuelson |
| | 361,289 March 24, 1982 | A Process for Activating Cellulose Pulp with NO and/or $NO_2$ and Oxygen in the Presence of Nitric Acid and then Delignifying Bleaching the Activated Cellulose Pulp | Samuelson |

The activation process is influenced by a number of factors. These factors include, inter alia, the quantity of nitrogen-dioxide-containing gas charged, time and temperature. Differing temperatures in the various stages of the activation process influence the final result. The nitrate content and the hydrogen ion content of the system during the activation process also have a decisive influence on the course of the activation. The need for supplying expensive nitrogen-dioxide containing gas can be greatly reduced by charging nitrate ions and hydrogen ions to the activation stage. Selectivity can also be optimized by optimizing, inter alia, the above parameters.

In this way, activation can be utilized to carry the degree of delignification quite far. When delignifying sulphate pulp with the aid, for example, of oxygen-gas bleaching processes, it is generally expected that at most half of the lignin remaining after the digestion stage can be removed, if one is to maintain sufficiently high strength properties in the resultant bleached cellulose pulp. When the lignin content of the pulp is expressed in Kappa number, the best result which could previously be achieved in the oxygen gas bleaching of sulphate pulp is a lowering of the Kappa number from, e.g., 35 to 17, or from 30 to 15. On the other hand, in optimal cases, it has been found possible, when applying activation of the cellulose pulp, to lower the Kappa number after activation and the following delignification stages, e.g., in the form of an oxygen-gas bleaching stage, from 30 to 35 to as low as 7, while still maintaining sufficiently high strength properties in the resultant bleached cellulose pulp.

When activating aqueous lignocellulosic material with the aid of nitrogen dioxide, it has been found that by the end of the activation stage not all the nitrogen dioxide charged has been consumed, and combined with different chemical compounds in the lignocellulosic material, or has formed compounds in the liquid phase, but instead up to about 30% of newly-supplied nitrogen dioxide has converted to nitric oxide. This has a negative effect on the economy of the activation process, since the activating chemicals charged are not used to the full, and, above all, because of the almost insurmountable obstacles that arise from an environmental aspect, since if no measures are taken, this will result in the discharge from the activation stage of enormous quantities of toxic nitric oxide, together with the activated lignocellulosic material.

This problem can be resolved by reacting NO to form $NO_2$, by bringing the reactor gas into contact with a given stoichiometric or excess quantity of oxygen-containing gas. One method involves introducing oxygen, preferably pure oxygen (gaseous or in liquid state), into the reactor gas, preferably directly into the activation reactor, and within given quantity ranges. This method forms a building block with regard to applying the activation technique on a commercial scale, this technique being more advantageous from the aspect of selectivity than other treatment methods.

When applying activation with the use of nitrogen dioxide, there is thus a need for an alternative method of introducing oxygen-containing gas into the reactor gas. It has also been found that the quantities of inert gases present in the final period of the activation stage are much greater than expected, particularly with regard to several gases that are produced as a result of the activation of the lignocellulosic material.

In accordance with the present invention, these difficulties are overcome (a) by withdrawing at an appropriate time from the activation stage gas containing at least 1.2 mmol nitrogen oxides, including NO, per liter, determined at 25° C. and calculated as nitrogen, reacting this withdrawn gas with oxygen in an amount corresponding to from about 10 to about 200 mole percent, calculated on the amount of NO present, and then recycling the reacted gas to the activation stage; and (b) by withdrawing and also separating gas containing less than 0.4 mmol nitrogen oxides, including NO, per liter determined at 25° C. and calculated as nitrogen during another different but appropriate stage of the activation process, other than that in which gas rich in nitrogen oxides is separated therefrom, and removing this separated gas from the activation process.

Preferably, oxygen is added to the gas rich in nitrogen oxides in an amount corresponding to from 30 to about 100 mole percent, calculated on the amount of NO present.

Accordingly, the process according to the invention comprises:

(1) subjecting chemical cellulose pulp to activation by reaction with nitrogen dioxide in the presence of water at a temperature within the range from about 20° to about 120° C., while (a) separating gas containing at least 1.2 mmol nitrogen oxides including NO per liter of gas determined at 25° C. and calculated as nitrogen, reacting nitrogen oxides in said withdrawn gas with oxygen gas in an amount within the range from about 10 to about 200 mole percent, calculated on the amount of NO present, and recycling the reacted gas to the activation; and (b) separating gas containing less than 0.4 mmol nitrogen oxides, including NO, per liter of gas determined at 25° C. and calculated as nitrogen from the cellulose pulp and removing said gas from the process; and (2) delignifying the activated cellulose pulp.

In order to obtain to the greatest extent the advantages afforded by the invention, in stage (a) the gas should be separated from the cellulose pulp in an amount such that at least 0.1 mole nitric oxide is reacted with oxygen for each mole of nitrogen dioxide newly supplied to the activation process, after which the gas enriched in $NO_2$ is recycled for activation of the cellulose pulp.

The process is applicable to any chemical cellulose pulp that has been converted, either totally or partially, to cellulose pulp with the aid of chemicals. The invention is particularly suited for use with chemical cellulose pulp that has been manufactured in accordance with both alkaline pulping processes and sulphite pulping processes. Examples of alkaline pulping processes include the sulphate process, the polysulphide process, and the soda (=sodium hydroxide) process, with or without chemical additives, such as quinone compounds.

The oxygen-treated gas can be dealt with in various ways in accordance with the invention. According to one embodiment of the invention, this gas is returned to the activation stage from which it was separated, and the gas concerned is brought into contact with the cellulose pulp at a location which, when seen in the forward feed direction of the material, lies up stream of the location at which fresh gas containing nitrogen dioxide is charged to the system.

It is preferred that activation of the cellulose pulp be divided into two stages; that fresh gas containing nitrogen dioxide is charged immediately prior to or at the beginning of the second stage; that gas rich in nitrogen oxides is separated from the cellulose pulp at the end of the second activation stage; that the gas rich in nitrogen oxides, subsequent to being treated with oxygen, is supplied to the cellulose pulp in the first activation stage; and that gas lean in nitrogen oxides is separated from the cellulose pulp at a location which lies upstream of the location at which gas containing nitrogen dioxide is charged to the system, as seen in the forward feed direction of the cellulose pulp.

According to one embodiment of the invention, subsequent to being delivered to the cellulose pulp the newly supplied gas containing nitrogen dioxide is caused to accompany the material in concurrent flow, in its direction of movement, whereas all or part of the oxygen-treated gas rich in nitrogen oxides, subsequent to being charged to the cellulose pulp, is caused to pass in countercurrent flow on a direction opposite to the direction in which the cellulose pulp is advanced.

According to a further embodiment of the invention, the oxygen-treated gas rich in nitrogen oxides is introduced into the cellulose pulp at the midway point, or approximately at the midway point, of the first activation stage, the gas flow being divided so that a part of said flow passes in countercurrent flow, in a direction opposite to that in which the cellulose pulp moves, while the remainder passes in concurrent flow therewith. In this case, gas lean in nitrogen oxides is separated from the first activation stage in the vicinity of the location at which the cellulose pulp is introduced to the first activation stage.

According to yet another embodiment of the invention, the cellulose pulp is passed through a reactor that incorporates three zones. These zones comprise an introduction zone, an intermediate zone, and a discharge zone. Gas lean in nitrogen oxide is separated from the cellulose pulp at some point in the introduction zone and carried away therefrom, while gas rich in nitrogen oxides is separated from the pulp at the end of the discharge zone. This gas is treated with oxygen. Two streams of the treated or processed gas are fed to the reactor, one to the introduction zone and the other to the intermediate zone.

The gas fed to the introduction zone is preferably treated with oxygen in an amount which exceeds slightly the amount required to oxidize nitric oxide to nitrogen dioxide. A smaller amount of oxygen is preferably used when treating the gas fed to the intermediate zone.

The newly charged gas containing nitrogen dioxide may comprise pure nitrogen dioxide ($NO_2$). The nitrogen dioxide may also be produced on site, i.e., in or externally of the activation reactor, by reacting nitric oxide (NO) with oxygen ($O_2$). The term "dinitrogen dioxide" as used here is also meant to include nitrogen tetroxide ($N_2O_4$) and other polymer forms. One mole of dinitrogen tetroxide is calculated as two moles of nitric oxide. Adducts which incorporate nitric oxide are calculated in the same way as nitric oxide. Dinitrogen trioxide ($N_2O_3$) is thus calculated as one mole of nitric oxide and one mole of nitrogen dioxide.

By the general designation "nitrogen oxides" as used herein is meant either nitric oxide or nitrogen dioxide or a mixture of these two gases. The term "nitrogen oxides", however, is not meant to include nitrous oxide ($N_2O$).

By "gas rich in nitrogen oxides" is meant a reactor gas which contains in total at least 1.2 mmol per liter, determined at 25° C. and calculated as nitrogen, of nitrogen oxides, including NO. The nitric oxide content of the gas totally dominates, and normally reaches an amount which is at least ten times greater (at time one hundred times greater) than the amount of nitrogen dioxide present. By "gas lean in nitrogen oxides" is meant a reactor gas which contains in total only a small amount of less than 0.4 mmol per liter determined at 25° C. and calculated as nitrogen, of nitrogen oxides, including NO. On the other hand, this gas contains significant quantities of gas which is inert during the reaction process and which is generated during activation of the lignocellulosic material, for example in the form of nitrous oxide ($N_2O$) and carbon dioxide ($CO_2$).

While the concentration of nitrogen oxides in the gas lean in nitrogen oxides need only be less than 0.4 mmol per liter, determined at 25° C. and calculated as N, depending on environmental requirements it is possible to decrease this concentration to 0.04 or even 0.01 mmol per liter gas, without too high costs for the equipment.

The corresponding concentration of the nitrogen oxides rich gas is preferably more than three times that of the gas lean in nitrogen oxides. As a rule the preferred concentration in a continuously working plant is within the range from 1.2 to 10 mmol per liter calculated on the same basis.

Table I and Examples 1 to 5 show that the amount of nitric oxide in the gas phase after 60 minutes is 18 mmol. That corresponds to a volume percent of about 25%. That means that about 75% corresponds to gases other than nitrogen oxide gases.

As beforementioned, in accordance with the invention, it is not necessary to treat with oxygen all of the gas rich in nitrogen oxides separated from the lignocellulosic material, but that part of this gas can be caused to bypass the oxygen treatment location and be solely returned to the same activation reactor from which it was taken, or to another activation reactor, or to a reservoir for storage for some other use. The first two instances result in a greater flow of gas through the reactor concerned, which may be a positive factor. Neither is it necessary, in accordance with the invention, to deliver the oxygen-treated gas rich in nitrogen oxides to one and the same end use location; advantages can he had by dividing the gas for use in several end use locations.

In order to increase the flow of gas through the reactor, it is also possible to recirculate a part of the separated gas lean in nitrogen oxides to the same reactor. It is also possible to transport the gas flow mentioned to another reactor.

The present invention enables the consumption of both oxygen and freshly supplied nitrogen dioxide to be reduced, in comparison with prior art techniques, while maintaining selectivity at a high level.

In certain cases, it has also been found possible to achieve a somewhat improved pulp quality, for example a pulp with improved strength qualities, despite a lower consumption of nitrogen dioxide, compared with prior art techniques. The yield subsequent to delignifying the cellulose pulp, compared at the same lignin content, has also been improved in some cases, even though the result achieved sometimes shows that the effect is small.

The invention also affords environmental advantages, since it proposes a solution to the problem of separating inert gases from the reactor gas, which gases would otherwise accumulate in the reactor, e.g. in continuous cellulose pulp activating processes, to such an extent as to render the necessary supply of nitrogen dioxide to the reactor chamber lightly problematic.

Another advantage afforded by the method according to the invention, and one which is often of still greater importance, is that it is possible when practicing the method to decrease the emission of nitric oxide and nitrogen dioxide when activating cellulose pulp, both by removing from the process gas that has a low content of nitrogen dioxide and nitric oxide, and by decreasing the amount of gas that must be removed. This latter benefit is achieved by bringing the amount of inert gas to a low level, in accordance with the invention.

Figure 1:
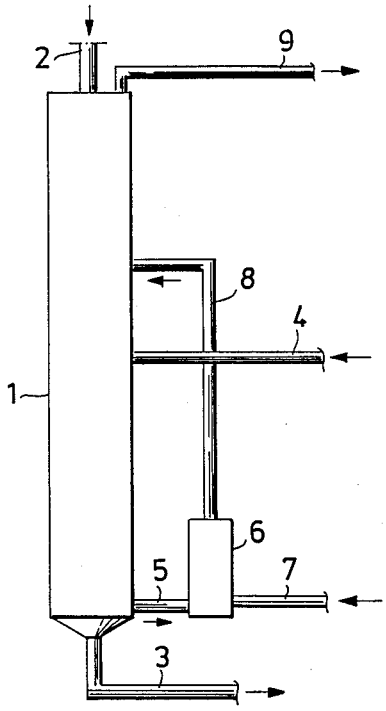
FIG. 1 is a flow sheet illustrating one embodiment of the method according to the invention.

The general parameters associated with the activation stage and suitable for use when practicing the method according to the invention are given below, and are followed by a relatively complete description of various specified embodiments of the method according to the invention with reference to the aforesaid flow schematics. The description is concluded with a working example that involves one embodiment of the invention.

Nitrogen dioxide or an equivalent amount of nitric oxide (plus oxygen) can be supplied in an amount lying within the range of 2–50 kg $NO_2$ for each 1000 kg of absolute dry lignocellulosic material. In order to enable activation to be effected with a low addition of nitrogen dioxide it is necessary for the lignocellulosic material charged to the activation process to contain nitrate in a concentration of at least 0.15 moles per kg of water, and for the pH of the liquid accompanying said material to lie beneath 7, preferably beneath 4. Nitrogen dioxide charges below 15 kg per 1000 kg of absolute dry lignocellulosic material are only applied when nitrate is present in large quantities, e.g. 0.2–0.4 mole per kg of water, and when the liquid accompanying the lignocellulosic material contains acid. Lower contents of nitrate also contribute to the activation of the lignocellulosic material, particularly at high reaction temperatures.

The temperature during the activation stage is within the range from about 20° to about 120° C. Because of the risk of pronounced depolymerization of the carbohydrates in the cellulose pulp, it is often preferable not to employ temperatures above 95° C. An advantage is afforded when low temperatures, e.g. temperatures within the range from about 20° to about 45° C., are employed during and immediately prior to that stage of the activation process in which gas lean in nitrogen oxides is separated from the lignocellulosic material and removed. Although the temperature can be held constant during the whole of the activation process, it is preferred to vary the temperature during said process. For example, in the case of many types of cellulose pulp it is preferable to maintain a high temperature during the final stages of the activation process, e.g. a temperature within the range from about 60° to about 95° C.

The activation stage may require from 2 to 240 minutes, a longer period of time being employed at low temperatures, and a shorter period at high temperatures. The most suitable time is within the range from about 20 to about 120 minutes, although longer periods are preferred with certain types of cellulose pulps, such as sulphate pulp produced in accordance with counterflow cooking techniques.

The maximum gas pressure during the activation stage normally is within the range from about 0.1 to about 0.2 MPa. Pressure is not critical, and lower and higher pressures can be used.

The pulp consistency during the activation stage may be within the range from about 2% to about 70%. The apparatus presently available on the market operate best at a medium consistency, i.e. a consistency of from about 8 to about 18%, and a high consistency, i.e. a consistency from about 27 to about 60%. However, activation of cellulose pulp which has an intermediate pulp consistency of from about 18 to about 27% gives good results.

According to one embodiment of the invention, illustrated in the flow sheet of FIG. 1 cellulose pulp moves down in the reactor 1, after introduction into the reactor through the conduit 2. Activated cellulose pulp is discharged from the reactor through the conduit 3, optionally after flushing out with washing liquor (not shown) obtained from a washing stage in which activated lignocellulosic material has been washed. Nitrogen dioxide or nitric oxide plus oxygen gas is supplied to the reactor through the conduit 4. Gas containing at least 1.2 mmol per liter of nitrogen oxides is separated from the cellulose pulp and removed from the reactor through the conduit 5, and is passed to a container 6, in which it is brought into contact with oxygen gas supplied through the conduit 7. The gases are mixed together with the aid, for example, of a mixing nozzle located in the vicinity of the bottom of the container 6.

Oxygen reaction with the gas rich in nitrogen oxides to regenerate $NO_2$ is preferably carried out at a temperature within the range from 20° to 120° C., for from 0.5 to 30 minutes. The pressure is preferably maintained at 0.1 to 0.2 MPa during the treatment, i.e. equal to or immediately above atmospheric pressure. The amount of oxygen gas supplied is regulated to correspond to from 10 to 200, preferably from 30 to 100 mole percent, calculated on the nitric oxide NO present in the reactor gas. Pronounced advantages can be obtained with regard to the smoothness of the activation process, by cooling the gas mixture or the treated gas, these advantages being reflected in the form of improved pulp properties of the delignified cellulose pulp. The gas is cooled indirectly, enabling the reactor heat to be utilized in a known manner.

The gas exiting from the container 6 is introduced into the reactor 1 through the conduit 8. The conduit 8 is connected to the reactor 1 some distance above the place at which the conduit 4 joins the reactor 1, in a commercial activation reactor, from 1 to 10 meters above.

Gas containing less than 0.4 mmol per liter nitrogen oxides is separated from the lignocellulosic material, at the top of the reactor 1, and is removed through the conduit 9. This gas can be handled in several ways. For example, the gas can be passed to a soda recovery unit, and there mixed with the air used in the combustion of cooking liquor. Alternatively, the gas can be passed to a vessel that contains wood in chip form for absorption of nitrogen oxides, and then discharged to atmosphere through a smoke stack or chimney. The gas may also be passed to a separate gas cleaning system.

If it is desired to achieve an optimum activation effect, and a minimum amount of nitrogen oxides in the gas discharged through the conduit 9, the pressure relationships in the reactor 1 should be so controlled so that a portion of the gas delivered to the reactor 1 through the conduit 8 is passed through the cellulose pulp in countercurrent flow thereto and the remaining portion is moved in concurrent flow, i.e. in the same direction as the cellulose pulp.

Figure 2:
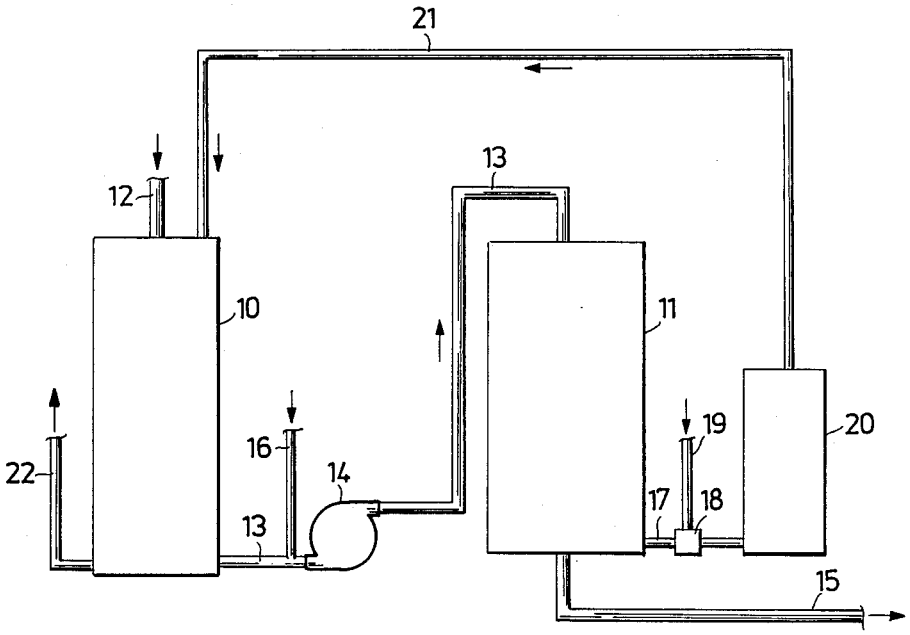
FIG. 2 is a flow sheet illustrating another embodiment of the method according to the invention.

According to another embodiment of the method of the invention, illustrated in the flow sheet of FIG. 2, the activation process is divided into two stages, and is effected in both the reactor 10 and the reactor 11. The lignocellulosic material is fed to the reactor 10 through the conduit 12, and passes down through the reactor, and is removed through the conduit 13. The cellulose pulp is brought to the top of the reactor 11 with the aid of conveyor 14, eg. in the form of a fan assembly, mixer, or the like, and then after the treatment in the reactor 11 the activated cellulose pulp leaves through the conduit 15.

Nitrogen dioxide is delivered to the cellulose pulp through the conduit 16, and is mixed effectively with the pulp with the aid of a fan or blower 14. The cellulose pulp can be conveniently carried to the reactor 11 with the aid of gas taken out at the top of the reactor 11, and returned to the fan 15 (not illustrated in the Figure).

Gas rich in nitrogen oxides is removed from the bottom of the reactor 11, and passed through the conduit 17 to a mixing nozzle 18, where the gas is mixed with oxygen gas supplied through the conduit 19. The resultant gas mixture is thereafter passed to the reactor 20 for continued reaction to regenerate $NO_2$. The oxygen-treated gas is then passed through the conduit 21 to the top of the reactor 10.

As mentioned above it may be suitable to subject this gas to a heat-exchange process at some point, prior to the gas coming into contact with the cellulose pulp, in order to adjust the temperature of the gas during the activation.

The gas lean in nitrogen oxides is separated from the cellulose pulp at the bottom of the reactor 10, and is passed through the conduit 22 to a treatement location, in accordance with that described above.

In this embodiment of the invention, the gas always flows in the same direction as the transport direction of the cellulose pulp, for as long as the gas phase and said material are in contact with one another.

Figure 3:
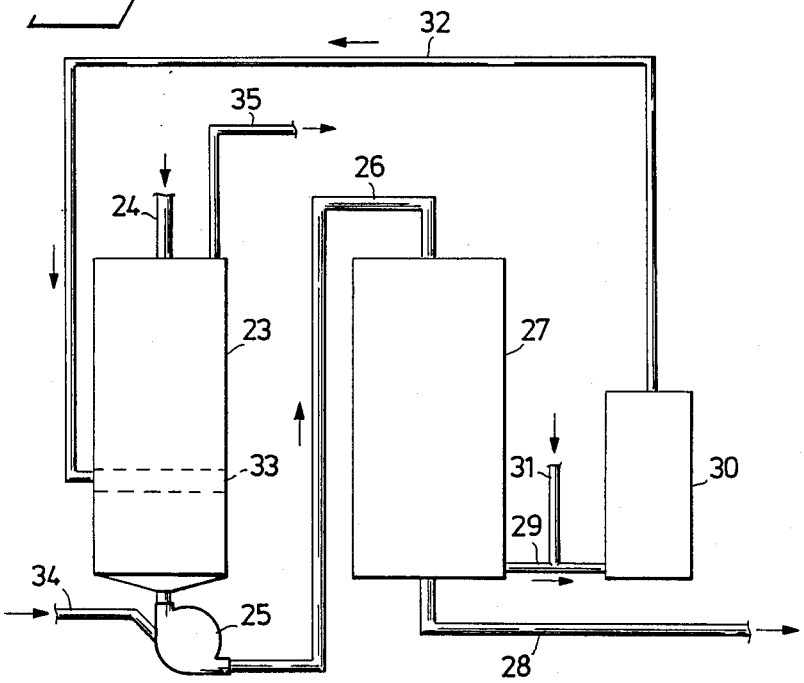
FIG. 3 is a flow sheet illustrating a third embodiment of the method according to the invention.

In the embodiment illustrated in FIG. 3, cellulose pulp is delivered to a first reactor 23 through the conduit 24. The pulp passes down through the reactor 23 to the conveyor 25, e.g. in the form of a fan or blower assembly, by means of which the pulp is passed through the conduit 26 to a second reactor 27, from which the cellulose pulp is fed out through the conduit 28. Nitrogen dioxide is supplied through the conduit 34, and mixed effectively with the cellulose pulp, by delivering the gas in the immediate vicinity of the fan assembly 25. Gas rich in nitrogen oxides is separated from the cellulose pulp at the bottom of the reactor 27, and is passed through the conduit 29 to the oxygen treatment reactor 30. The requisite amount of oxygen gas to regenerate $NO_2$ is delivered through the conduit 31. The oxygen-treated gas is passed through the conduit 32 to a location on the reactor 23, this location in the case of the illustrated embodiment lying in the vicinity of the midway point of the reactor. At this location there is provided a gas distributor 33 (shown in broken lines), which is positioned on the periphery of the cylindrical reactor 23. Part of the gas is forced to pass through the cellulose pulp in counter-current flow, i.e. towards the top of the reactor, while the remainder of the gas is caused to flow in concurrent flow, i.e., in the same direction as that used by the cellulose pulp.

Gas lean in nitrogen oxides is separated from the cellulose pulp at the top of the reactor 23, and removed through the conduit 35.

This embodiment of the invention affords important environmental advantages. For example, removal of gas that is lean in nitrogen oxides can be controlled with the aid of a fan or some other type of gas transporter, such as a cell-feeder, connected to the conduit 35. This in turn influences the manner in which the oxygen-treated gas is divided quantitatively into the portions which move in concurrent or counter-current flow to the cellulose pulp. The method is therefore highly flexible.

The embodiments of the method according to the invention describe hitherto are particularly suited for activating cellulose pulp at high consistencies, e.g. from 25 to 60%. In consistencies within this range, no liquid is pressed from the liquid-containing cellulose pulp as it passes through the reactor or reactors. In all of these embodiments of the invention, mechanical devices for finely dividing the material (fluffing) are incorporated immediately upstream of the location at which the cellulose pulp is introduced into the reactor or reactors (not illustrated in the drawings, and not necessary).

Figure 4:
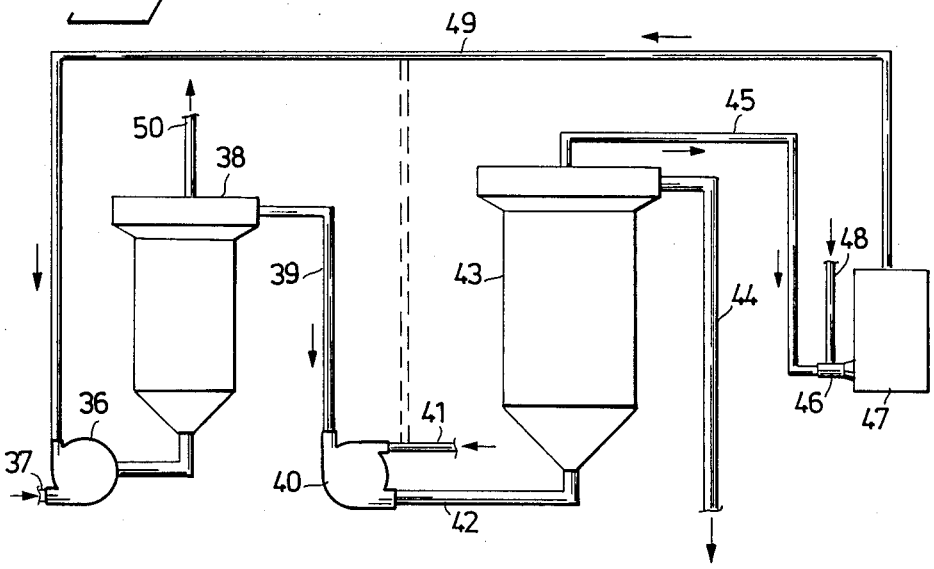
FIG. 4 is a flow sheet illustrating a fourth embodiment of the method according to the invention.

The embodiment of the method according to the invention illustrated in FIG. 4 is particularly applicable to pulps of medium consistency, e.g. consistencies from 8 to 20%.

Cellulose pulp is fed via a mixer 36 through the conduit 37 to a first reactor 38. The cellulose pulp passes from the bottom to the top of the reactor 38, and removed therefrom through the conduit 39. The pulp is then fed to a gas mixer, mixer 40. A mixer of the kind normally used for mixing oxygen gas with lignocellulosic material in the oxygen-gas bleaching of pulps of medium consistency (slot mixer) can be used. The nitrogen dioxide is delivered through the conduit 41. The cellulose pulp is then fed through the conduit 42 to a second reactor 43, through which the material passes from the bottom to the top thereof. The cellulose pulp is removed from the top of the reactor 43, and led away from the reactor through the conduit 44.

Gas rich in nitrogen oxides is separated from the cellulose pulp at the top of the reactor 43, and passed through the conduit 45 and the nozzle 46 to the oxygen gas treatment reactor 47. The requisite amount of oxygen gas to regenerate $NO_2$ is supplied through the conduit 48. After optionally subjecting the oxygen-treated gas to a heat-exchange process in the reactor 47, the gas is passed through the conduit 49 to the arrangement 36, and there mixed with the cellulose pulp.

Gas lean in nitrogen oxides is removed from the first reactor 38 and passed through the conduit 50, for handling as described in FIGS. 1 to 3.

In order to render activation of the cellulose pulp more flexible, a portion of oxygen-treated gas rich in nitrogen oxides (indicated by the conduit shown in broken lines in the Figure) can be diverted and conducted to the mixer 40. By taking out this portion at some other location in the container 47, or by mixing the portion with separated gas rich in nitrogen oxides from the conduit 45, the portion can be caused to have a composition different from that of the gas treated with oxygen-gas returned to the gas mixer 36.

According to a further embodiment of the invention, it is also possible in the system of FIG. 4 to move part or all of the supply of fresh nitrogen dioxide from the conduit 41 to a conduit close to the bottom of the second reactor 43.

As mentioned above, the oxygen-gas consumption of the process is very low. Despite this, it is still possible to reduce the amount of nitrogen dioxide plus nitric oxide removed from the system to a surprisingly low level. This is achieved by regulating the total amount of gas and the proportions of nitric oxide and nitrogen dioxide in the various gas flows in a manner such that the gas lean in nitrogen oxides contains an adapted quantity of oxygen gas, whereas the gas rich in nitrogen oxides, when separated from the cellulose pulp, is normally substantially free from oxygen gas. By substantially free is meant here that no registerable oxygen peaks occur when subjecting the gas to gas chromatographic analysis, and in the subsequent assay of the gas with the aid of hot-air detectors. Analysis of the gas with the aid of conventional analyzers shows the level of oxygen ($O_2$) to be less than 5% of the nitric oxide content of the gas.

This combination of measures enables the amount of gas lean in nitrogen oxides, which must necessarily be removed from the activation process, to be reduced to a surprisingly low level.

Preferably the activated cellulose pulp removed from the activation stage is washed, in order to remove as much as possible of the acid liquor from the activation.

The cellulose pulp is then delignified in at least one delignification stage. Delignification of the material in solely a single stage in an alkaline environment is normally sufficient. The alkali used may be any chemical that is capable of releasing primarily hydroxide ions, although sodium hydroxide is preferred in this regard.

Excellent results are obtained when there is used in the delignification stage, in addition to alkali also oxygen, e.g. oxygen gas, with a pressure within the range from about 0.15 to about 0.4 MPa. Good delignification results are also obtained when delignification is divided into two stages, for example, with different alkali in each stage. For example, sodium bicarbonate and/or sodium carbonate can be used in the first stage, and sodium carbonate and/or sodium hydroxide in the second stage. The use of oxygen gas under a given pressure is also preferred in this latter case, particularly in the second delignification stage.

Before the end use or final bleaching, the cellulose pulp then is subjected to washing.

The following Examples in the opinion of the inventors represent preferred embodiments of the invention.

EXAMPLES 1 TO 5

An unbleached screened sulphate pulp manufactured from softwood (chiefly Pinus Silvestris) was taken from the mill, and leached at room temperature for thirty minutes with water containing sulphur dioxide ($SO_2$) at pH 1.5, in order to dissolve out ash (inorganic) constituents from the pulp. The pulp was then washed with deionized water and carefully conditioned at a dry solids content of 35%. After the bleaching, the pulp was found to have a Kappa number of 29.9 and a viscosity of 1172 $dm^3/kg$. The pulp was then activated in batches of 125 g of absolute dry pulp. Precisely determined quantities of sodium nitrate ($NaNO_3$) and 10%-nitric acid ($HNO_3$) were mixed with water, and kneaded into the pulp at room temperature immediately prior to activation, calculated so that the impregnated pulp contained 0.25 mole $NaNO_3$ and 0.1 mole $HNO_3$ per kg of the total amount of water in the pulp. The consistency, defined as grams of dry pulp calculated per gram of dry pulp plus grams total water, was 26%.

The activation was effected in a two liter glass reactor. After introducing the chemical-impregnated pulp into the reactor, the reactor was evacuated and heated to 55° C., while being rotated in a water bath. Nitrogen dioxide was supplied to the pulp in an amount corresponding to 2%, calculated on the absolutely dry pulp, and followed immediately by either oxygen gas or 200 ml of helium, in order to flush down all nitrogen dioxide present into the reactor, and bring it into contact with the pulp. Separate experiments have shown that the presence of helium has no effect on either the lignin content of the pulp, the viscosity, or yield, or the amount of nitric oxide in the gas phase.

Immediately after introducing the gases, the temperature was raised, increased gradually over a period of 20 minutes from 55° C. to 68° C., and heated at 68° C. for a total activation time of 60 minutes.

Five batches were treated out in accordance with the method of the invention, together with five controls. Before delignifying the pulp with oxygen gas, the activated pulp was washed with water, so as to remove substantially all acid products from the pulp. The washed pulp was divided into five batches, each of which was bleached with oxygen gas for a period of 0, 20, 40, 70 and 120 minutes, respectively under the following conditions:

| | |
|---|---|
| Pulp consistency = | 8% by weight |
| Amount of NaOH charged = | 10% by weight, calculated on absolutely dry pulp |
| Amount of magnesium = charged as $MgSO_4$ | 0.2% by weight calculated on absolutely dry pulp |
| Temperature = | 106° C. |
| Oxygen-gas pressure = | 0.4 MPa |

No oxygen gas was charged to the activation stages in the Examples in accordance with the invention. However, the nitrogen dioxide was displaced immediately (washed down) with 200 ml helium, as before mentioned. When carrying out the Controls, oxygen gas was charged to the reactor so as to reach atmospheric pressure therein, both immediately after charging nitrogen dioxide to the reactor (corresponds to the time 0) and after 5 and 30 minutes reaction time, respectively.

The results are set forth in Table I.

TABLE I

| | Amount of oxygen charged during activation, mmol after | | | Oxygen-gas consumption during activation process, mmol after | | Nitric Oxide in the gas phase after | | Oxygen-gas bleaching time in | Kappa | Oxygen-gas bleached pulp viscosity | Yield |
|---|---|---|---|---|---|---|---|---|---|---|---|
| | 0 min | 5 min | 30 min | 30 min | 60 min | 60 min | mmol | min | No. | $dm^3/kg$ | % |
| Example No. | | | | | | | | | | | |
| 1 | 0 | 0 | 0 | 0 | 0 | 18 | 33 | 0 | 19.9 | 1088 | — |
| 2 | 0 | 0 | 0 | 0 | 0 | 18 | 33 | 20 | 9.1 | 996 | 95.8 |
| 3 | 0 | 0 | 0 | 0 | 0 | 18 | 33 | 40 | 7.8 | 958 | 94.9 |
| 4 | 0 | 0 | 0 | 0 | 0 | 18 | 33 | 70 | 7.0 | 938 | 94.2 |
| 5 | 0 | 0 | 0 | 0 | 0 | 18 | 33 | 120 | 5.8 | 852 | 93.5 |
| Control | | | | | | | | | | | |
| 1 | 44.6 | 8.2 | 1.0 | 31 | 36 | 0 | 0 | 0 | 19.3 | 1066 | — |
| 2 | 44.6 | 8.2 | 1.0 | 31 | 36 | 0 | 0 | 20 | 10.2 | 989 | 95.7 |
| 3 | 44.6 | 8.2 | 1.0 | 31 | 36 | 0 | 0 | 40 | 8.9 | 961 | 95.2 |
| 4 | 44.6 | 8.2 | 1.0 | 31 | 36 | 0 | 0 | 70 | 7.6 | 919 | 94.4 |
| 5 | 44.6 | 8.2 | 1.0 | 31 | 36 | 0 | 0 | 120 | 6.7 | 865 | 93.7 |

The number of mmoles of $O_2$ and NO relate to each 125 gram batch of absolutely dry pulp.
All percentages are by weight.

When activating the pulp in accordance with the invention there is obtained at the end of the activation stage a nitric oxide content of 33% calculated on the number of moles of nitrogen dioxide charged to the system. This gas rich in nitrogen oxides can be recovered, and subsequent to adding oxygen thereto can be used as an activating chemical for the activation of a fresh pulp charge.

The five Examples in accordance with the invention simulate an industrial method, insomuch as no oxygen was supplied to the activation reactor at any time during the activation process.

The data in the Table show that the pulp treated in accordance with the invention has a Kappa number as low as 5.8. This shows that delignification can be carried quite far, when applying the method according to the invention, despite the lower consumption and the smaller charges of chemicals used in the activation process, compared with the Controls. The selectivity of the five pulps of the Examples is also slightly better than that of the Control pulps. Pulp yields compared at the same lignin contents are the same in each, athough the yield of the pulps treated in accordance with the invention may be slightly higher than that of the Control pulps.

The experiments show that pulp of very high quality can be produced by the method according to the invention. However, in order to avoid negative environmental effects, the method according to the invention requires the use of apparatus which is more complicated than that used when oxygen-gas is supplied directly to the activation reactor.

Having regard to the foregoing disclosure the following is claimed as the inventive and patentable embodiments thereof:

1. A process for the activation and delignification of cellulose pulp, which comprises:

(1) subjecting chemical cellulose pulp to activation by reaction with nitrogen dioxide in the presence of water at a temperature within the range from about 20° to about 120° C., while (a) withdrawing from the pulp gas containing at least 1.2 mmol NO and other nitrogen oxides per liter of gas determined at 25° C. and calculated as nitrogen, reacting NO in said withdrawn gas with oxygen gas in an amount within the range from about 10 to about 200 mole percent, calculated on the amount of NO present, and recycling the reacted gas to the activation; and (b) separating from the pulp gas containing less than 0.4 mmol NO and other nitrogen oxides per liter of gas determined at 25° C. and calculated as nitrogen from the cellulose pulp and removing said gas from the process; and (2) delignifying the activated cellulose pulp.

2. A process according to claim 1, in which the oxygen gas is in an amount of from 30 to 100 mole percent, calculated on the nitric oxide present.

3. A process according to claim 1, in which gas separated in step (a) is separated in an amount such that at least 0.1 mole nitric oxide is reacted with oxygen for each mole of nitrogen dioxide newly supplied to the activation.

4. A process according to claim 1, in which gas separated in step (a) subsequent to reaction with oxygen, is returned to the activation stage from which the gas was separated, and brought into contact with the cellulose pulp at a location upstream of the location at which gas containing fresh nitrogen dioxide is supplied.

5. A process according to claim 1, in which the activation is divided into two stages, and a fresh charge of gas containing nitrogen dioxide is made at least at the beginning of the second activation stage, whereas the gas containing at least 1.2 mmol NO and other nitrogen oxides is separated from the cellulose pulp at the end of the second activation stage, and the gas containing less than 0.4 mmol NO and other nitrogen oxides is separated from the cellulose pulp at a location upstream of the location at which gas containing nitrogen dioxide is added.

6. A process according to claim 5, in which subsequent to being mixed into the cellulose pulp the gas containing nitrogen dioxide is caused to accompany the pulp in concurrent flow.

7. A process according to claim 5, in which subsequent to being added to the cellulose pulp at least part of the oxygen-treated gas containing at least 1.2 mmol NO and other nitrogen oxides is caused to pass in countercurrent flow to the cellulose pulp.

8. A process according to claim 5, in which the oxygen-treated gas containing at least 1.2 mmol NO and other nitrogen oxides is added to the cellulose pulp near to the center of a reactor for carrying out the first activation stage; the gas flow is divided so that a part thereof passes in countercurrent flow to the cellulose pulp and a further part in concurrent flow to said pulp, and in that gas lean in nitrogen oxides is separated from the first activation stage near to the location at which the cellulose pulp is introduced into the first activation stage.

9. A process according to claim 1, in which the cellulose pulp is caused to pass through an introduction zone, an intermediate zone, and a discharge zone in a reactor; the gas containing less than 0.4 mmol NO and other nitrogen oxides is separated from the cellulose pulp in the introduction zone and removed therefrom, and the gas containing at least 1.2 mmol NO and other nitrogen oxides is separated from the cellulose pulp at the end of the discharge zone, and subsequent to being reacted with oxygen, is recycled partly to the introduction zone and partly to the intermediate zone.

* * * * *